US007629930B2

(12) United States Patent
Murch et al.

(10) Patent No.: US 7,629,930 B2
(45) Date of Patent: Dec. 8, 2009

(54) SYSTEMS AND METHODS USING GROUND PLANE FILTERS FOR DEVICE ISOLATION

(75) Inventors: Ross D. Murch, Kouloon (CN); Chi-Yuk Chiu, Diamond Hill (CN); Corbett Rowell, New Territories (CN)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 445 days.

(21) Appl. No.: 11/584,332

(22) Filed: Oct. 20, 2006

(65) Prior Publication Data

US 2008/0094302 A1 Apr. 24, 2008

(51) Int. Cl.
*H01Q 1/38* (2006.01)

(52) U.S. Cl. ..... 343/700 MS; 343/846; 343/909

(58) Field of Classification Search ..... 343/700 MS, 343/702, 909, 846
See application file for complete search history.

(56) References Cited

U.S. PATENT DOCUMENTS

| | | | | |
|---|---|---|---|---|
| 5,109,536 | A * | 4/1992 | Kommrusch | 455/82 |
| 5,815,805 | A | 9/1998 | Crnkovic et al. | |
| 6,288,679 | B1 | 9/2001 | Fischer et al. | |
| 6,392,600 | B1 | 5/2002 | Carson et al. | |
| 6,943,746 | B2 | 9/2005 | Talvitie et al. | |
| 6,954,177 | B2 * | 10/2005 | Channabasappa et al. | 343/700 MS |
| 2005/0040992 | A1 | 2/2005 | Chirila | |

FOREIGN PATENT DOCUMENTS

| | | |
|---|---|---|
| EP | 1 315 238 | 5/2003 |
| JP | 2001-144644 | 5/2001 |
| WO | WO 01/039322 A1 | 5/2001 |
| WO | WO03055091 | 7/2003 |
| WO | WO2005083893 | 9/2005 |
| WO | WO2006001110 | 1/2006 |

OTHER PUBLICATIONS

Christophe Caloz et al., "A Simple and Accurate Model for Microstrip Structures With Slotted Ground Plane," IEEE Microwave and Wireless Components Letters, vol. 14, No. 4, Apr. 2004, pp. 133-135.

Younkyu Chung et al., "High Isolation Dual-Polarized Patch Antenna Using Integrated Defected Ground Structure," IEEE Microwave and Wireless Components Letters, vol. 14, No. 1, Jan. 2004, pp. 4-6.

(Continued)

*Primary Examiner*—Tan Ho
(74) *Attorney, Agent, or Firm*—Fulbright & Jaworski L.L.P.

(57) ABSTRACT

A system for reducing unwanted signals comprises a ground plane, a first active component disposed so as to cause signals in the ground plane, a second active component disposed so as to cause signals in the ground plane, wherein the ground plane provides a path for the signals from the first active component to affect the second active component and for the signals from the second active component to affect the first active component, and a filter element configured as a pattern in the ground plane receiving and attenuating the signals from each of the first and second active components.

20 Claims, 5 Drawing Sheets

| CENTER OPERATING FREQUENCY | 1.90 GHz | 2.35 GHz | 3.20 GHz |
|---|---|---|---|
| g | 55 mm (0.348 λo) | 43 mm (0.337 λo) | 32 mm (0.341 λo) |
| l | 34 mm (0.215 λo) | 26 mm (0.204 λo) | 19 mm (0.203 λo) |
| w | 5 mm (0.032 λo) | 5 mm (0.039 λo) | 5 mm (0.053 λo) |
| d | 22 mm (0.139 λo) | 15 mm (0.118 λo) | 13 mm (0.139 λo) |
| h | 6 mm (0.038 λo) | 6 mm (0.047 λo) | 6 mm (0.064 λo) |
| NO. OF SLIT PAIRS ON GROUND PLANE | 5 | 5 | 4 |

OTHER PUBLICATIONS

Fan Yang et al., "Microstrip Antennas Integrated With Electromagnetic Band-Gap (EBG) Structures: A Low Mutual Coupling Design for Array Applications," IEEE Transactions On Antennas and Propagation, vol. 51, No. 10, Oct. 2003, pp. 2936-2946.

Y.J. Sung et al., "Harmonics Reduction With Defected Ground Structure for a Microstrip Patch Antenna," IEEE Antennas and Wireless Propagation Letters, vol. 2, 2003, pp. 111-113.

Dal Ahn et al., "A Design of the Low-Pass Filter Using the Novel Microstrip defected Ground Structure," IEEE Transactions on Microwave Theory and Techniques, vol. 49, No. 1, Jan. 2001, pp. 86-93.

Dan Sievenpiper et al., "High-Impedance Electromagnetic Surfaces with a Forbidden Frequency Band," IEEE Transactions on Microwave Theory and Techniques, vol. 47, No. 11, Nov. 1999, pp. 2059-2074.

Long Li et al., "Locally Resonant Cavity Cell Model for Electromagnetic Band Gap Structures," IEEE Transactions on Antennas and Propagation, vol. 54, No. 1, Jan. 2006, pp. 90-100.

Debatosh Guha et al., "Microstrip Patch Antenna With Defected Ground Structure for Cross Polarization Suppression," IEEE Antenna and Wireless Propagation Letters, vol. 4, 2005, pp. 455-458.

Chen, Guan-Yu et al., "Simple PBG Structures Serve Microwave Designs," Microwaves & Rf, Nov. 2003, http://www.mwrf.com/Articles/Index.cfm?Ad=l&ArticleID=6859, Penton Media, Inc.

International Search Report issued for PCT/CN2007/070587, dated Nov. 22, 2007, 2 pages.

International Preliminary Report on Patentability, issued for PCT/CN2007/070587, dated Apr. 30, 2009, 6 pages.

* cited by examiner

| CENTER OPERATING FREQUENCY | 1.90 GHz | 2.35 GHz | 3.20 GHz |
|---|---|---|---|
| g | 55 mm (0.348 λ0) | 43 mm (0.337 λ0) | 32 mm (0.341 λ0) |
| l | 34 mm (0.215 λ0) | 26 mm (0.204 λ0) | 19 mm (0.203 λ0) |
| w | 5 mm (0.032 λ0) | 5 mm (0.039 λ0) | 5 mm (0.053 λ0) |
| d | 22 mm (0.139 λ0) | 15 mm (0.118 λ0) | 13 mm (0.139 λ0) |
| h | 6 mm (0.038 λ0) | 6 mm (0.047 λ0) | 6 mm (0.064 λ0) |
| NO. OF SLIT PAIRS ON GROUND PLANE | 5 | 5 | 4 |

SYSTEMS AND METHODS USING GROUND PLANE FILTERS FOR DEVICE ISOLATION

TECHNICAL FIELD

The present description relates, in general, to systems with ground planes and, more specifically, to adjusting ground plane characteristics to optimize performance of antenna systems.

BACKGROUND OF THE INVENTION

As antenna systems grow smaller, space between antenna elements in those systems becomes more scarce. Not only does the spacing between antenna elements have the potential to affect the radiation pattern of a system, but it can also affect the amount of mutual coupling between antenna elements. Mutual coupling is inductive/capacitive coupling between two or more antennas, and it can sometimes result in unwanted performance degradation by interfering with signals being transmitted or by causing an antenna element to radiate unwanted signals. Generally, the closer the placement of two antenna elements, the higher the potential for mutual coupling.

Accordingly, modern antenna designers generally look for ways to decrease coupling (i.e., increase isolation) between some antenna elements. This is especially true for multi-channel systems, as the signals on one channel should usually and ideally be unaffected by the signals on other channels. It is also particularly true for Multiple Input Multiple Output (MIMO) antenna systems which require several antennas to operate at the same frequency but work independently of each other.

Some antenna systems employ antenna elements placed above a ground plane. In such systems, the antenna elements can induce currents in the ground plane that travel to other antenna elements and increase undesired coupling. To decrease the coupling, various techniques have been devised. For example, one solution has been to split the ground plane so that two antennas that might interfere are not connected by a continuous ground plane. However, such systems generally produce an inadequate amount of isolation.

Other proposed systems include intricate fabrication processes to produce structures with cells shorted to the ground through vias in a Printed Circuit Board (PCB). Such structures generally act as bandstop filters and can be designed to cancel specific, unwanted signals. However, such systems are expensive in terms of both space and money because of the complexity of the three-dimensional shapes of the structures. Currently, no prior art system provides adequate isolation with a minimum of complexity.

BRIEF SUMMARY OF THE INVENTION

The present invention is directed to systems and methods for attenuating unwanted signals in a ground plane through use of a filter configured as a pattern in the ground plane. An example system includes two elements (e.g, antenna elements) with the filter positioned therebetween. The elements cause unwanted signals in the ground plane, and the filter is adapted to reduce and/or eliminate the effects of the signals from the system.

In one example, the filter is a simple ground plane structure that can reduce mutual coupling between closely-packed antenna elements. In such an example, the structure can include a slotted pattern etched onto a single ground plane upon which the antenna elements are disposed. The slotted configuration creates a filter that acts as an inductive/capacitive (LC) component in the ground plane, and the size and shape of the slots can be designed so that the filter attenuates certain frequencies known to be most prevalent and/or cause most interference. Similarly, the structure can be applied to reduce mutual coupling between three, four, or more radiating elements. The slotted single ground plane structure can be simple and cost-effective to fabricate in some embodiments.

As mentioned above, embodiments of the invention are applicable for use in antenna systems, such as between two parallel individual planar inverted-F antennas (PIFAs) sharing a common ground plane. In another specific example, the mutual coupling between half-wavelength patches and monopoles can also be reduced with the aid of a filter disposed in the ground plane structure. One application for embodiments of the invention is in the design of compact antennas for MIMO wireless communication systems. Embodiments of the invention are further adaptable for use in attenuating unwanted signals caused by elements other than antenna elements. For example, any device including a populated Printed Circuit Board (PCB) with various components thereon causing unwanted signals may benefit from certain embodiments.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
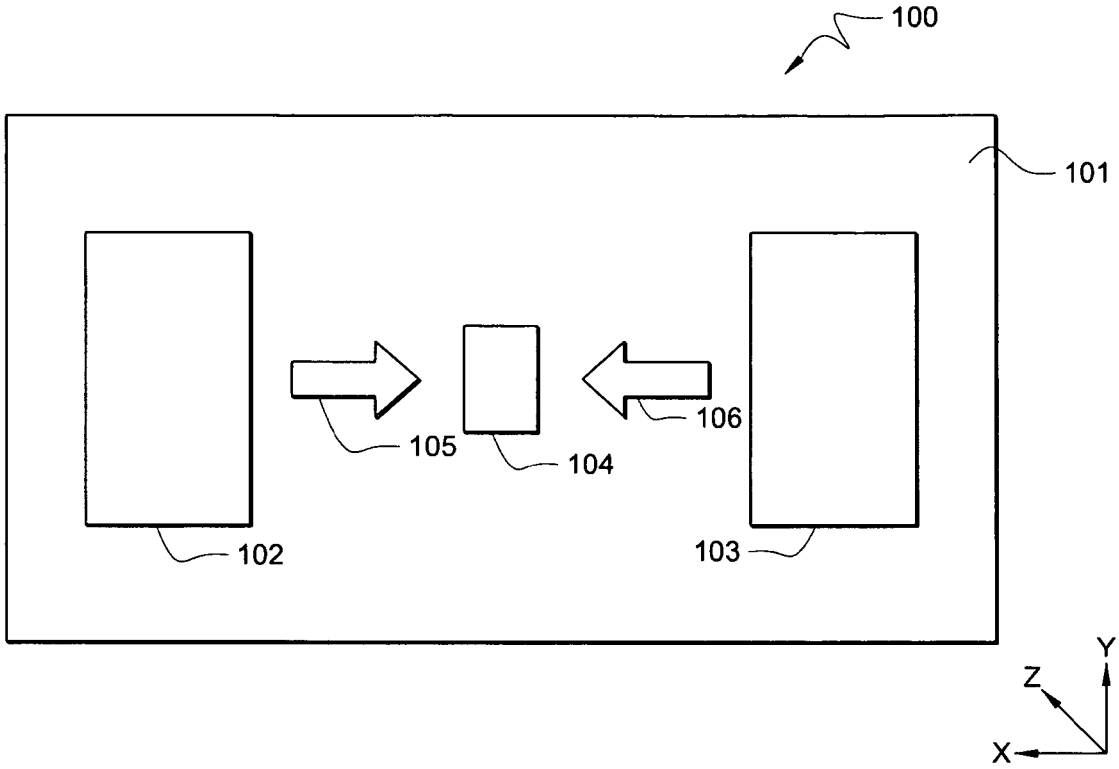
FIG. 1 is an illustration of an exemplary system adapted according to one embodiment of the invention.

FIG. 1 is an illustration of exemplary system 100 adapted according to one embodiment of the invention. System 100 includes ground plane 101, which is typically a conductive layer of material disposed on a substrate (not shown), such as upon a layer of a Printed Circuit Board (PCB). In some embodiments, ground plane 101 may cover substantially the entire area of one side of a substrate or may cover a substrate only partially. However, ground plane 101 is not limited thereto, as no one structure or substrate is required in some embodiments.

System 100 further includes active components 102 and 103 disposed proximate to ground plane 101. In one example, one or more of elements 102 and 103 are antenna elements, such as patch or Planar Inverted F Antenna (PIFA) type elements disposed on a substrate with some or all of the surface area thereof overlapping in the z-axis with ground plane 101. Such antenna elements are at least partially grounded. In another example, at least one of active components 102 and 103 is a Radio Frequency (RF) module sending/receiving RF signals in communication with one or more antennas. In fact, active components 102 and 103 can be any kind of component that is operable to cause signals in ground plane 101.

When active components 102 and 103 transmit data (e.g., for an antenna by resonating or for an RF module by sending/receiving signals through a port that is near or in a ground plane), each element 102 and 103 causes signals 105, 106 in ground plane 101. Signals 105 and 106 are induced currents that travel in ground plane 101 and can cause unwanted effects in the respective other active component 103 and 102. The phenomenon is referred to as "mutual coupling" or "cross coupling" between elements 102 and 103, and it is sometimes undesirable as it can create additional resonances.

In system 100, filter 104 is disposed as a pattern in the surface of ground plane 101. Filter 104 is adapted to receive and attenuate signals 105 and 106, thereby increasing isolation for each of active components 102, 103. It is not necessary in some embodiments for filter 104 to completely remove signals 105 and 106, as long as signals 105 and 106 are attenuated to some degree before reaching the respective other active component. For example, in one embodiment, attenuation of approximately twenty decibels is achieved.

Figure 2:
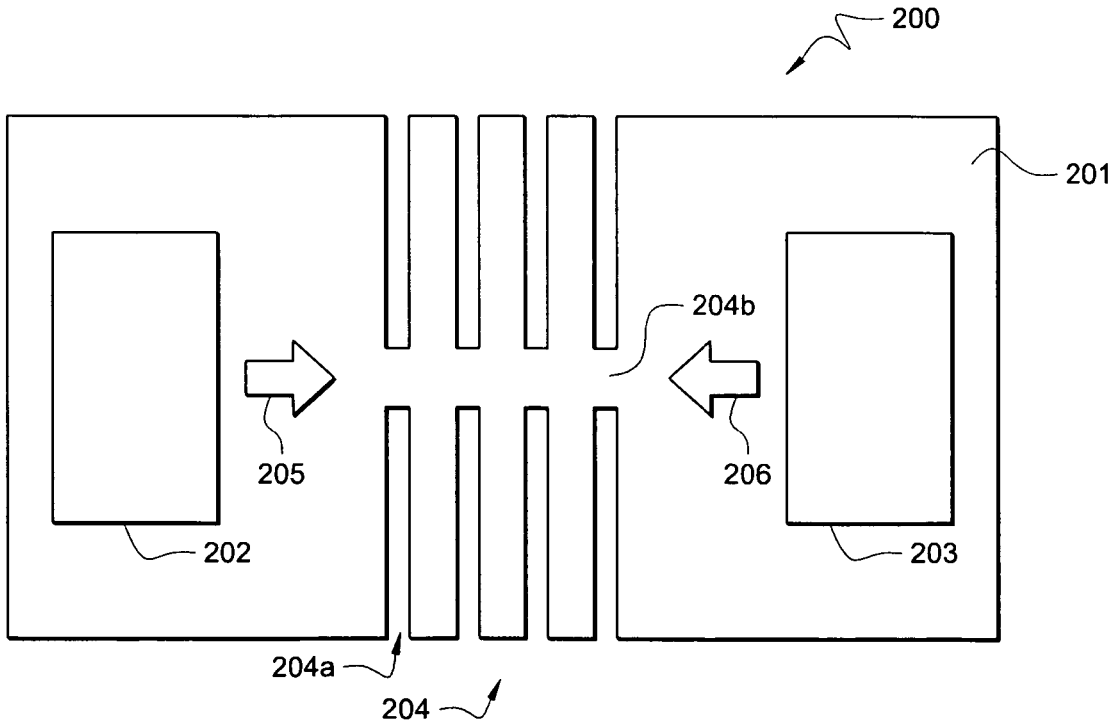
FIG. 2 is an illustration of an exemplary system adapted according to one embodiment of the invention.

FIG. 2 is an illustration of exemplary system 200 adapted according to one embodiment of the invention. System 200 is configured according to FIG. 1, and it includes more detail with regard to one embodiment. System 200 includes ground plane 201, antenna elements 202 and 203, filter 204, and signals 205 and 206.

In system 200, filter 204 is shown as a ground plane modification. Specifically, ground plane 201 includes eight slots (e.g., slot 204*a*). The slots in this example are orthogonal to a straight line path between elements 202 and 203, and the slots do not extend the whole distance across ground plane 201 such that solid conductive path 204*b* is formed thereon making the pattern appear similar to ribs and a backbone. The numbers, orientation, and sizes of the slots are merely exemplary, and other embodiments may include different configurations, as explained in more detail below.

When system 200 is viewed in a circuit context, it should be noted that the slots of filter 204 add reactance thereto. Specifically, the slots add a capacitive reactance component ("C"), and conductive path 204*b* adds an inductive reactance component ("L"). Thus, filter 204 is, in effect, an "LC" component.

The dimensions of system 200 determine, at least in part, the frequency response of filter 204. Generally, the lengths and widths of the individual slots define the sizes and spacing of the ribs, which can increase or decrease the capacitive component of filter 102. Specifically, as the ribs get closer together and wider, the capacitance thereof typically increases. Also, the inductance of backbone 204*b* tends to increase as it narrows. Further, the number of slots typically affects the amount of attenuation at a given frequency rather than affecting the frequency response of filter 204. For example, more slots usually provide greater attenuation, but also take up more surface area on ground plane 201. Thus, a typical design process involves shaping the slots to provide the correct frequency response while including enough slots to provide the desired amount of attenuation within the available surface area. Interelement spacing also generally affects the performance of system 200.

Table 2, below, is provided to describe some of the design constraints for a system, such as system 200, which takes the basic form shown in FIG. 3 (described further below) wherein the elements are PIFAs in a parallel arrangement. The values in Table 2 correspond to a system wherein the ground plane size is forty-three mm by forty-three mm, but the principles are generally applicable. Table 2 details the interelement spacing, number of slit pairs used, center frequency of the PIFAs, operating impedance bandwidth, and maximum mutual coupling ($S_{21}$) within the operating frequency band. It can be observed that for centre to centre spacings of greater than 0.12 wavelengths isolations of better than −15 dB can be achieved with some embodiments of the invention. For separations of less than 0.12 wavelengths both bandwidth and isolation deteriorate in this example. As can be seen in Table 2, the isolation goes up to a maximum value and then drops again as the number of slit pairs is increased.

TABLE 2

| Center to center distance (mm) | No. of slit pairs on ground plane | Center operating frequency (GHz) | Operating BW (%) | Max $S_{21}$ within operating band (dB) | Center to center distance ($\lambda_0$) |
|---|---|---|---|---|---|
| 9 | 2 | 2.50 | 0 | −6.7 | 0.075 |
| 11 | 3 | 2.41 | 1.66 | −7.9 | 0.088 |
| 13 | 3 | 2.43 | 4.54 | −9.4 | 0.105 |
| 13 | 4 | 2.39 | 3.77 | −11.9 | 0.104 |
| 15 | 4 | 2.40 | 4.17 | −14.8 | 0.120 |
| 15 | 5 | 2.36 | 4.24 | −18.0 | 0.118 |
| 17 | 4 | 2.42 | 4.13 | −17.9 | 0.137 |
| 17 | 5 | 2.40 | 4.17 | −19.7 | 0.136 |
| 17 | 6 | 2.35 | 3.83 | −13.5 | 0.133 |
| 19 | 3 | 2.46 | 3.66 | −15.9 | 0.156 |
| 19 | 4 | 2.44 | 4.10 | −19.7 | 0.155 |
| 19 | 5 | 2.41 | 4.15 | −18.3 | 0.153 |
| 19 | 6 | 2.38 | 4.62 | −12.7 | 0.151 |
| 19 | 7 | 2.33 | 4.72 | −9.1 | 0.148 |

Figure 3:
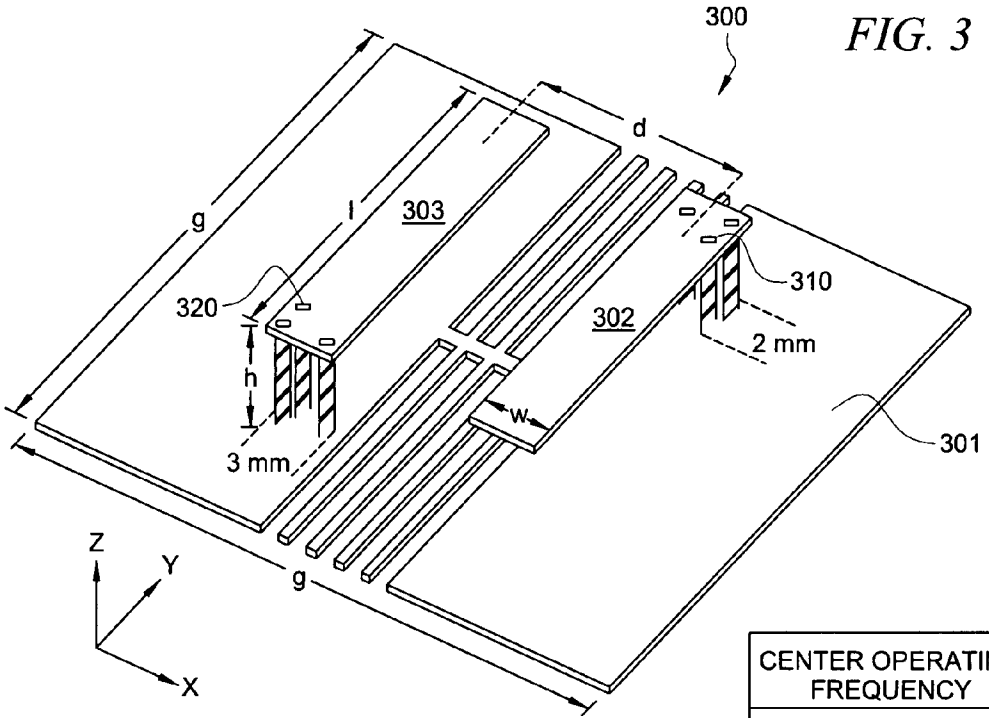
FIG. 3 is an illustration of an exemplary system adapted according to one embodiment of the invention.

FIG. 3 is an illustration of exemplary system 300 adapted according to one embodiment of the invention. System 300 is configured according to the design of system 200 (FIG. 2), and it includes dimensions in Table 1. The dimensions are included in order to explain the operation of one specific embodiment, and are not intended to limit the scope of the invention. System 300 includes ground plane 301 and antenna elements 302 and 303. Antenna elements 302 and 303 are PIFA-type patch antennas that are elevated slightly above the surface of ground plane 301. Antenna element 302 includes signal feed 310 that may be connected to RF circuitry, supplying element 302 with a modulated RF signal for transmitting and providing a path for received RF signals to be fed to RF circuitry for demodulation. Antenna element 303 similarly includes signal feed 320. Because antenna elements 302 and 303 are fed from opposite ends, such arrangement may be referred to as "alternate side feeds." Various embodiments of the invention are not so limited, as same side feeds, and even non-parallel element arrangements can be used in some embodiments.

The numbers of slot pairs in Table 1 are exemplary, as other numbers can be used. The values in Table 1 are optimized for performance in system 300 at the listed antenna band center frequencies. In optimized systems, center operating frequencies generally correspond to the centers of stop bands for the filter. For the example at 2.35 GHz center operating frequency, performance may be optimized by making each of the slots 21 mm by 1 mm. At different center frequencies, it may be desirable to use slots of different dimensions in order to create a filter with an appropriate stop band.

Figure 4A:
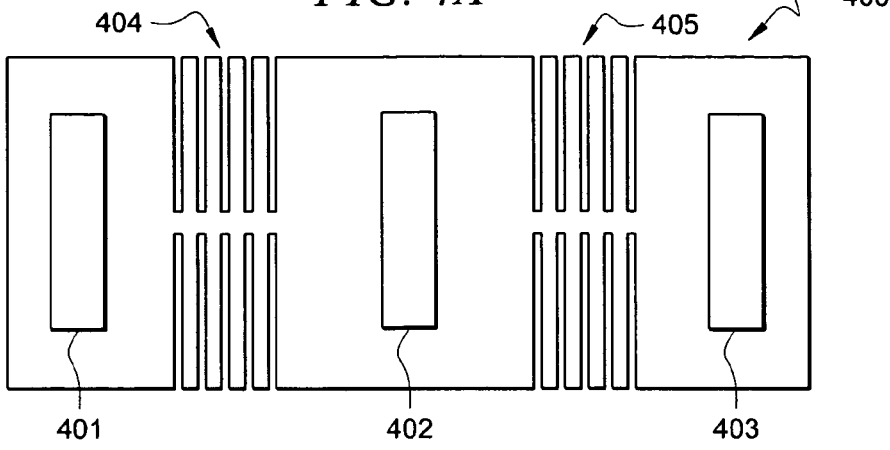
FIG. 4A is an illustration of an exemplary system adapted according to one embodiment of the invention.
Figure 4B:
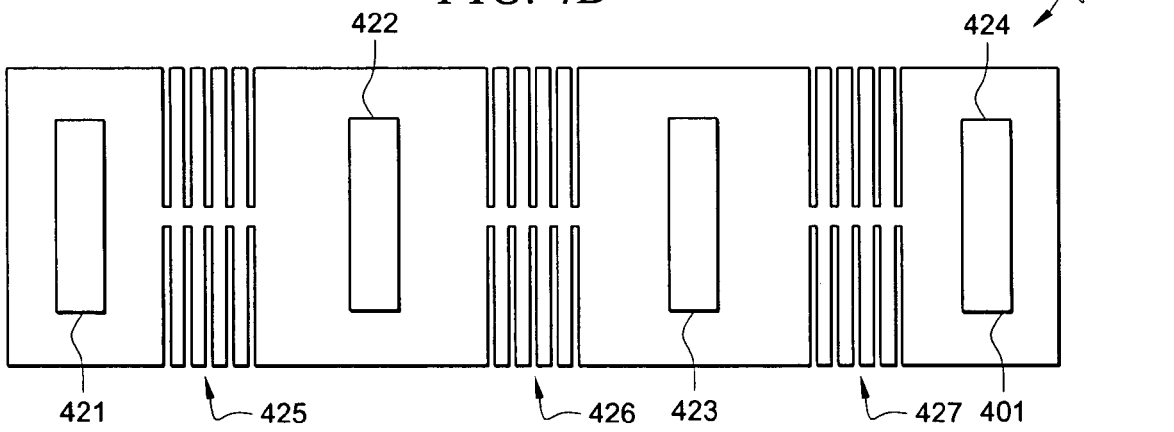
FIG. 4B is an illustration of an exemplary system adapted according to one embodiment of the invention.

Systems according to the configuration of systems 100 (FIG. 1), 200 (FIG. 2), and 300 may be scalable to include more antenna elements and more filters. FIG. 4A is an illustration of exemplary system 400 adapted according to one embodiment of the invention. System 400 includes antenna elements 401-403 and ground plane filters 404 and 405. When designed for performance at a center frequency of around 2.45 GHz, system 400 may provide an approximately twenty decibel decrease in cross-coupling compared to a similar antenna system without filters 404 and 405. FIG. 4B is an illustration of exemplary system 420 adapted according to one embodiment of the invention. In system 420, there are four antenna elements 421-424 and three filters 425-427. FIGS. 4A and 4B demonstrate that systems can be designed with two, three, four, or even more ground plane filters.

Figure 4C:
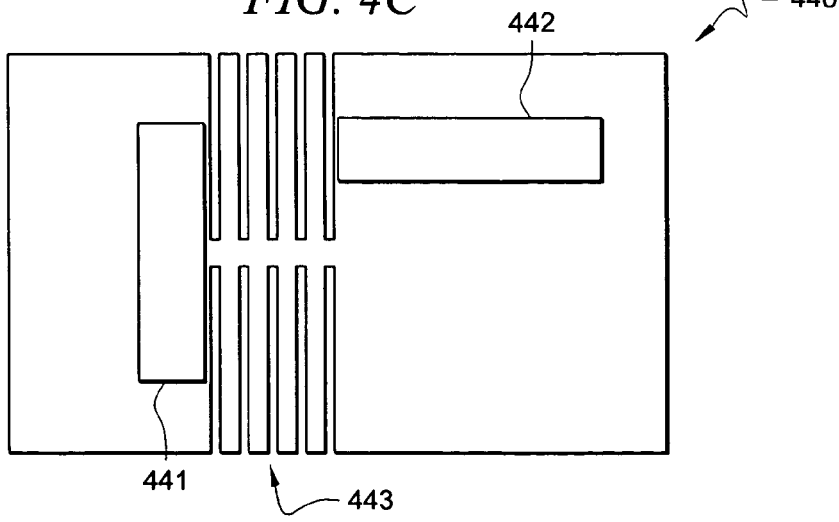
FIG. 4C is an illustration of an exemplary system adapted according to one embodiment of the invention.
Figure 4D:
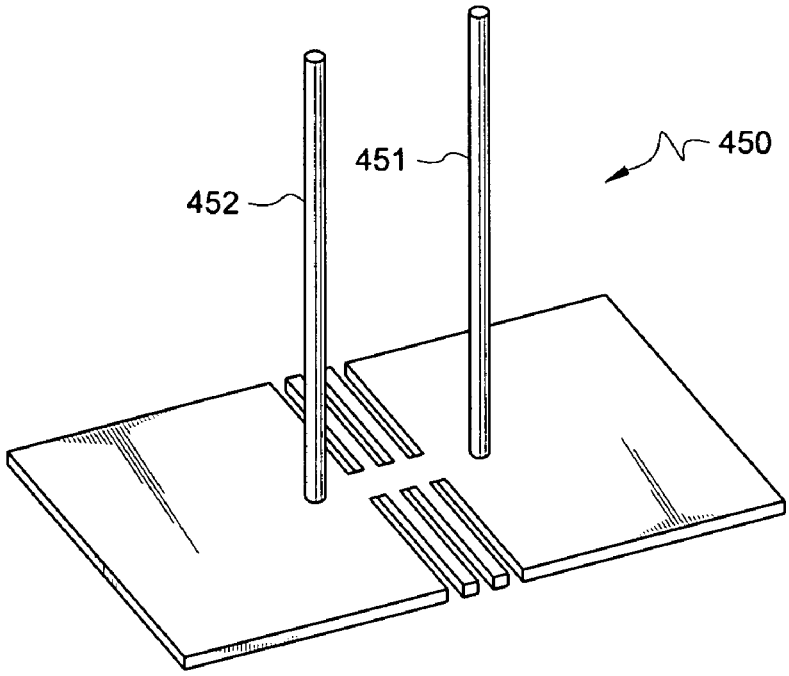
FIG. 4D is an illustration of an exemplary system adapted according to one embodiment of the invention.

A variety of arrangements are also possible for some embodiments. FIG. 4C is an illustration of exemplary system 440 adapted according to one embodiment of the invention. System 440 includes antenna elements 441 and 442 that are arranged perpendicularly to each other, rather than parallel in the previous examples. FIG. 4D is an illustration of exemplary system 450 adapted according to one embodiment of the invention, and it shows vertically-oriented monopole antennas 451 and 452. The antenna elements can be of any of a variety of types now known or later developed, and the antenna arrangement is not limited to a planar structure, provided that the antenna elements have a ground plane. Various embodiments of the invention are not limited to parallel and/or perpendicular configurations, as any arrangement is possible. Further, there is no requirement that the antenna elements be coplanar with each other.

Figure 5:
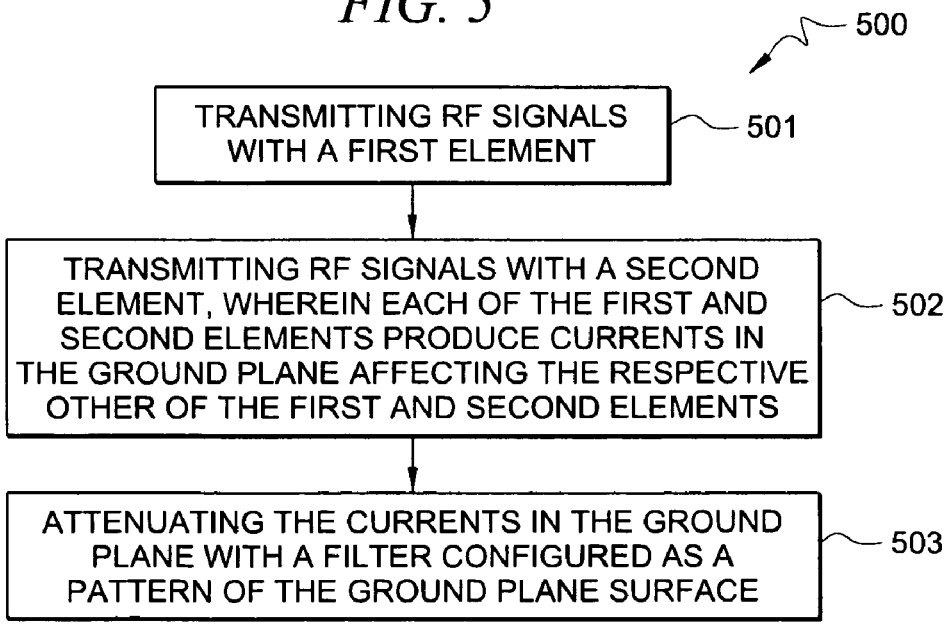
FIG. 5 is an illustration of an exemplary method adapted according to one embodiment of the invention for sending data using an antenna system.

FIG. 5 is an illustration of exemplary method 500 adapted according to one embodiment of the invention for sending data using an antenna system. In an example antenna system according to one embodiment of the invention, two elements are disposed proximate a ground plane, wherein the proximity is such that electrical and/or electromagnetic transmissions of signals by the elements causes appreciable currents in the ground plane. The elements may include antenna elements, RF modules, and/or any other component that can transmit electrical and/or electromagnetic signals and cause currents in the ground plane. In one example, the antenna system further includes a control system based in software and/or hardware that includes logic units for controlling the operation of the various components.

In step 501, RF signals are transmitted with a first element. Transmitting can include wireless and conductor-based transmissions. Thus, in one example, the transmitting is wireless using an antenna element, and in another example, the transmitting is along a wire trace in a PCB or other kind of electrical signal transmission.

In step 502, RF signals are transmitted with a second element, wherein each of the first and second elements produce currents in the ground plane affecting the respective other of the first and second elements. As in step 501, the transmitting can be by conductor and/or by radiation of electromagnetic signals. Further, each of the first and second elements' transmitting produces currents in the ground plane that affect the other element. The effecting can include, e.g., causing unwanted signals to reach the other component, possibly causing unwanted operation. The undesired signals may include, for example, signals with different informational content, signals with different frequency components, out-of-phase signals, and the like.

In step 503, the currents in the ground plane are attenuated with a filter configured as a pattern in the surface of the ground plane. In one example, the filter is created from slots in the ground plane that produce an LC effect. Attenuating includes completely or partially cancelling, blocking, and/or removing the signals in the ground plane.

While method 500 is shown as a series of steps, various embodiments of the invention may add, delete, or rearrange the order of steps. In fact, some steps may be performed simultaneously. For example, steps 501, 502, and 503 may be performed at (or very nearly at) the same time. Further, various systems may include more than two elements and more than one filter, as shown in FIGS. 4A and 4B, such that the transmitting and attenuating may be performed by more than a first and second element and a single filter. Method 500 can be adapted for use with a variety of configurations according to embodiments of the invention.

Embodiments of the invention may provide one or more advantages over other solutions. For instance, in some PCB-based devices a ground plane filter can be manufactured by etching, or even sawing, such that no new components are added, and the size of the ground plane may not need to be increased. This may lead to ease and economy of manufacturing. Further, it is possible in some embodiments to construct a ground plane filter from a single layer of conductive material so that it is simple to design and manufacture.

One prior art solution simply constructs the ground plane out of separate, coplanar layers—one for each active component. While those solutions may provide cross-coupling attenuation in the range of eight decibels or less, various embodiments of the present invention employing similar systems can often provide up to and exceeding twenty decibels of attenuation. Still further, by providing increased isolation various embodiments can facilitate higher capacity input and output (as in Multiple Input Multiple Output systems), can improve antenna efficiency and power consumption, and can facilitate closer spacing between elements than lesser performing systems.

Figure 6:
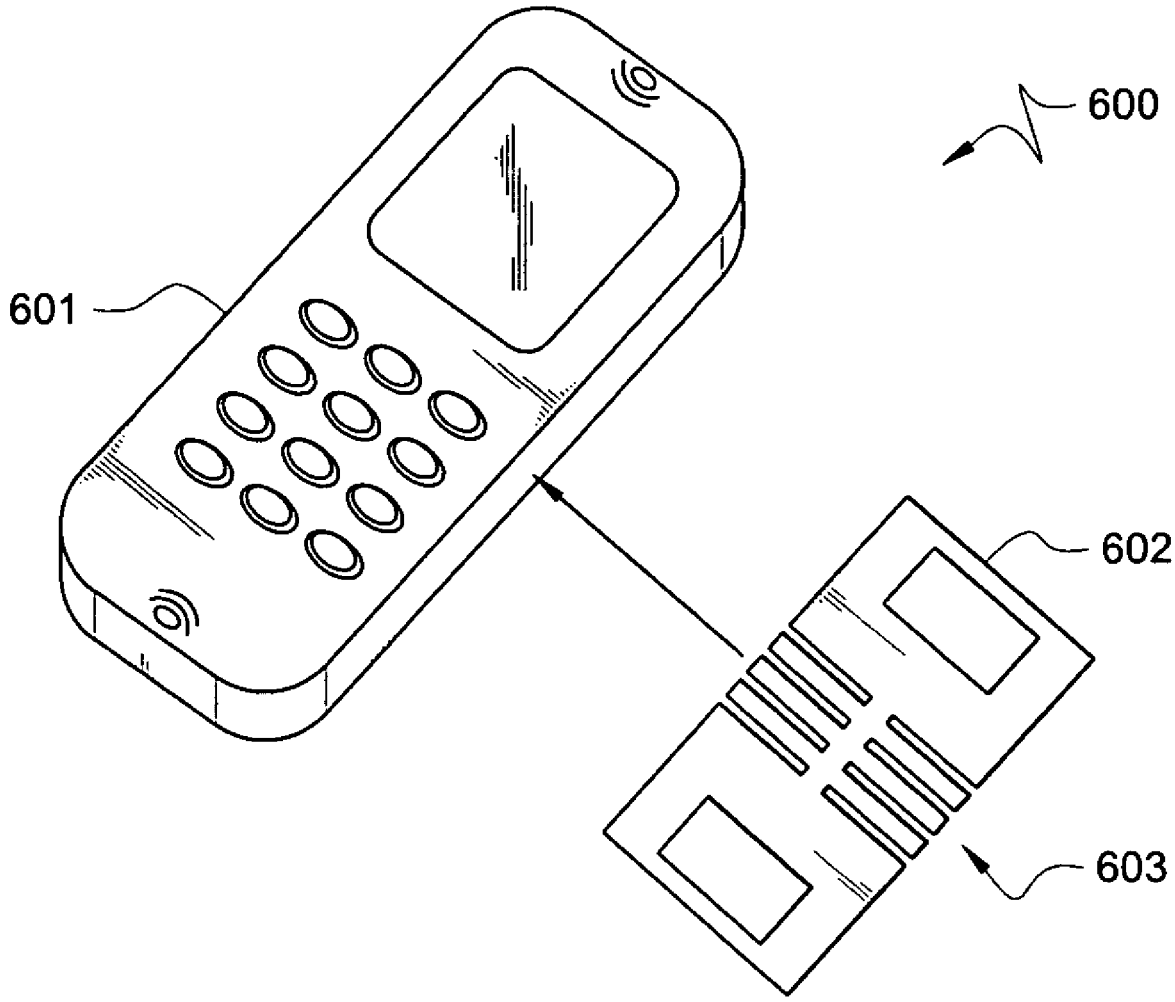
FIG. 6 is an exploded view of an exemplary system adapted according to one embodiment of the invention.

Systems and methods according to embodiments of the invention may be included in or performed by any of a variety of devices now known or later developed that include components proximate a ground plane that may produce interference. FIG. 6 is an exploded view of exemplary system 600 adapted according to one embodiment of the invention. System 600 includes an exemplary cellular handset incorporating ground plane 602 with filter element 603 therein, as described above with regard to FIGS. 1-4D. Different arrangements and orientations are possible, aside from that shown in FIG. 6.

Devices that may be adapted for use with various embodiments of the invention include, among others, processor-based systems with populated PCBs, wireless devices (e.g., phones, laptop computers, etc.) that use grounded antennas, wireless network routers, MIMO transmitters and receivers, and the like.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system for reducing unwanted signals, said system comprising:

a ground plane;

a first active component disposed so as to cause signals in said ground plane;

a second active component disposed so as to cause signals in said ground plane, wherein said ground plane provides a path for said signals from said first active component to affect said second active component and for said signals from said second active component to affect said first active component; and a filter element configured as a pattern in said ground plane receiving and attenuating said signals from each of said first and second active components, wherein said filter element comprises an inductive capacitive (LC) component including a plurality of elongated slots in a conductor of said ground plane.

2. The system of claim 1 wherein said ground plane and said plurality of slots are included in a single conductive layer.

3. The system of claim 1, wherein said elongated slots are perpendicular to a straight line path between said active components.

4. The system of claim 1 wherein said elongated slots are perpendicular to a straight line path between said active components, said conductor of said ground plane including a solid conductive path traversing said slots so that said filter corresponds to a rib-and-backbone configuration.

5. The system of claim 1 wherein said first and second active components are patch antenna elements, and wherein said active components and said ground plane are disposed upon a substrate.

6. The system of claim 1 wherein said first and second active components are Planar Inverted F Array (PIFA) antenna elements.

7. The system of claim 1 wherein said first active component is an antenna element, and wherein said second active component is an RF module providing RF signals to said antenna element.

8. The system of claim 1 wherein said first and second active components are monopole antenna elements.

9. The system of claim 1 wherein said system is incorporated in one of the following:

a cellular handset;

a laptop computer; and

Multiple Input Multiple Output (MIMO) transmitter.

10. A method for reducing unwanted signals, said method comprising:

transmitting Radio Frequency (RF) signals with a first element;

transmitting RF signals with a second element, wherein said first and second elements are each disposed proximate a conductive ground plane and spaced apart from each other, and wherein each of said first and second elements produce currents in said ground plane affecting the respective other of said first and second elements;

attenuating said currents in said ground plane with a filter configured as a pattern of said ground plane surface, said filter defined by a plurality of elongated slots in said ground plane with a conductive path traversing said plurality of slots.

11. The method of claim 10 wherein said ground plane is a single layer of conductive material, and wherein said filter is also a single layer.

12. The method of claim 10 wherein said first element is an RF module, and wherein said transmitting RF signals with said first element comprises:

transmitting and receiving said RF signals through a port via a conductor, said RF module disposed so as to cause said currents in said ground plane.

13. The method of claim 10 wherein said first element is an antenna element, and said transmitting RF signals with said second element comprises:

resonating said antenna to produce electromagnetic radiation.

14. The method of claim 10 wherein said pattern is two-dimensional.

15. An antenna system, said system comprising:

a ground plane with slots therein defining an inductive capacitive (LC) bandstop filter in said ground plane;

a first antenna element disposed above said ground plane;

an active element disposed above said ground plane, wherein said ground plane provides a path for signals from said antenna element to affect said active element and for signals from said active element to affect said antenna element, wherein said bandstop filter, said antenna element, and said active element are disposed such that said bandstop filter receives and attenuates said signals from each of said antenna element and said active element, wherein said slots define ribs in said ground plane, said ribs extending from the inside of said ground plane to the outside of said ground plane, said ribs connected by a conductive backbone strip in the inside of said ground plane.

16. The system of claim 15 wherein said active element is a second antenna element.

17. The system of claim 15 wherein said bandstop filter is defined by a surface pattern of said ground plane.

18. The system of claim 15 wherein said bandstop filter is defined by a two-dimensional pattern in the surface of said ground plane.

19. The system of claim 15 wherein said system is incorporated in one of the following:

a cellular handset;

a laptop computer; and

Multiple Input Multiple Output (MIMO) transmitter.

20. The system of claim 15 wherein said ground plane and said slots are included in a single conductive layer.

* * * * *

UNITED STATES PATENT AND TRADEMARK OFFICE

CERTIFICATE OF CORRECTION

PATENT NO. : 7,629,930 B2
APPLICATION NO. : 11/584332
DATED : December 8, 2009
INVENTOR(S) : Murch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 494 days.

Signed and Sealed this

Second Day of November, 2010

David J. Kappos

David J. Kappos
*Director of the United States Patent and Trademark Office*